US005575319A

United States Patent [19]

Chick

[11] Patent Number: 5,575,319

[45] Date of Patent: Nov. 19, 1996

[54] LOG SPLITTING APPARATUS FOR USE WITH CONVENTIONAL VEHICLE JACKS

[76] Inventor: Charles T. Chick, 741 SW. Lemans, Lee's Summit, Mo. 64082

[21] Appl. No.: 625,307

[22] Filed: Apr. 1, 1996

[51] Int. Cl.[6] ..... B27L 7/00

[52] U.S. Cl. ..... 144/195.4; 144/193.1; 144/366; 144/195.6

[58] Field of Search ..... 144/193.1, 195.4, 144/366, 195.6, 195.5

[56] References Cited

U.S. PATENT DOCUMENTS

| | | | |
|---|---|---|---|
| 280,657 | 7/1883 | Mors et al. | 144/195.6 |
| 953,162 | 3/1910 | Weinberg . | |
| 2,851,072 | 9/1958 | Gerjets et al. | 144/193.1 |
| 4,061,168 | 12/1977 | Fariss, Jr. . | |
| 4,244,407 | 1/1981 | McMullin | 144/195.4 |
| 4,354,537 | 10/1982 | Balkus | 144/195.5 |
| 4,362,194 | 12/1982 | Lawson | 144/193.1 |

*Primary Examiner*—W. Donald Bray
*Attorney, Agent, or Firm*—Donald A. Kettlestrings

[57] ABSTRACT

Log splitting apparatus for use in combination with a conventional vehicle jack includes a base for removably receiving and supporting the jack thereon and a first support connected to and extending upwardly from the base. A second support is connected to and extends outwardly from the first support and is located above the base. A log support is movably connected to and extends outwardly from the first support and is located between the base and the second support, and a wedge is provided in operative relationship with the second support for engaging and splitting a log positioned on the log support and beneath the wedge as the log support and the log are moved upwardly toward the second support by activation of the jack positioned between the base and the log support.

12 Claims, 6 Drawing Sheets

38
48
74
31
46'
42
31
40
28
46
46"
51
62
50

44'
64'
66'
30
66
44
64
72
71'
60'
60
71
32
69
32
69'
76
68
78'
78
28
70
80
27
80'
27'
26

LOG SPLITTING APPARATUS FOR USE WITH CONVENTIONAL VEHICLE JACKS

BACKGROUND OF THE INVENTION

This invention relates to log splitting apparatus and more particularly to log splitting apparatus for use with conventional vehicle jacks.

Many types of log splitting devices are known. For example, some machine operated log splitters use large hydraulic cylinders powered by gasoline motors. These devices are very expensive and are transported by towing them behind a truck.

At the other end of the scale of devices and methods for log splitting is the use of a simple wedge and a heavy hammer. Although the splitting of logs in this manner is relatively inexpensive, it requires considerable strength and stamina, and the process can be time consuming and unsafe.

It is, therefore, an object of the present invention to provide log splitting apparatus for use with conventional vehicle jacks.

Another object is to provide log splitting apparatus which is portable and easily transportable.

A further object of the invention is the provision of a log splitting apparatus which is easy and safe to operate.

Still another object is to provide log splitting apparatus which is less expensive than conventionally known log splitters which are powered by gasoline motors.

A still further object is to provide log splitting apparatus which is efficient to use and which permits an operator to split logs in a safe manner without requiring the physical exertion required by use of a conventional wedge and heavy hammer.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

SUMMARY OF THE INVENTION

To achieve these and other objects the present invention provides log splitting apparatus for use in combination with a conventional vehicle jack, the apparatus comprising: base means for removably receiving and supporting the jack thereon and for supporting the apparatus on the ground or other horizontal surface; a first support connected to and extending upwardly from the base means; a second support connected to and extending outwardly from the first support and located above the base means; a log support movably connected to and extending outwardly from the first support and located between the base means and the second support, the log support movably positionable along the first support to rest on the jack when the jack is positioned on the base means and beneath the log support; and wedge means in operative relationship with the second support for engaging and splitting a log positioned on the log support and beneath the wedge means as the log support and the log are moved upwardly toward the second support by conventional activation of the jack positioned between the base means and the log support.

It is to be understood that both the foregoing general description and the following detailed description are exemplary and explanatory but are not restrictive of the invention.

BRIEF DESCRIPTION OF THE DRAWINGS

The accompanying drawings, which are incorporated in and constitute a part of this specification, illustrate a preferred embodiment of the invention and, together with the description, serve to explain the principles of the invention.

DESCRIPTION OF THE PREFERRED EMBODIMENT

Figure 1:
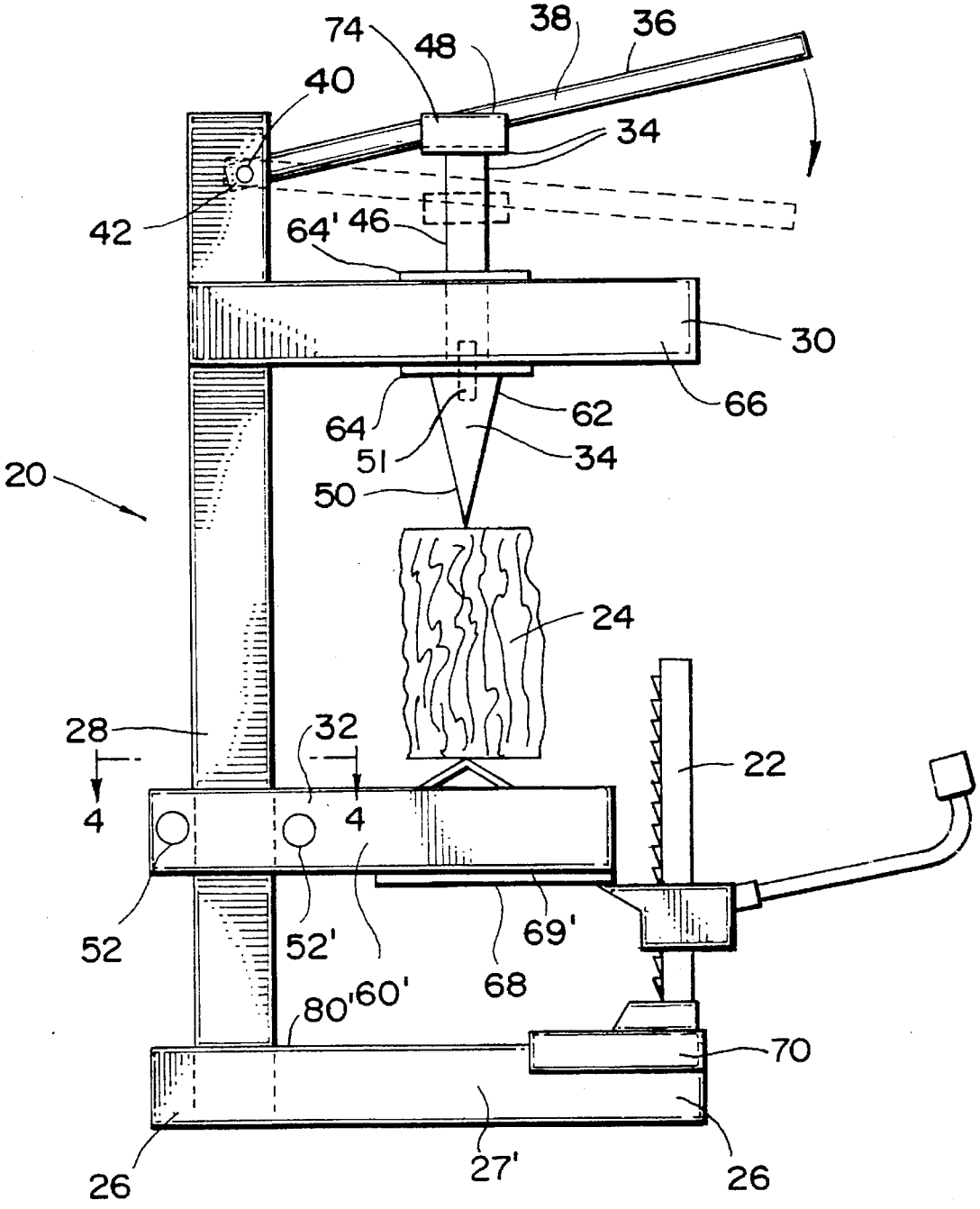
FIG. 1 is a side elevation view showing the log splitting apparatus with a log positioned to be split.
Figure 2:
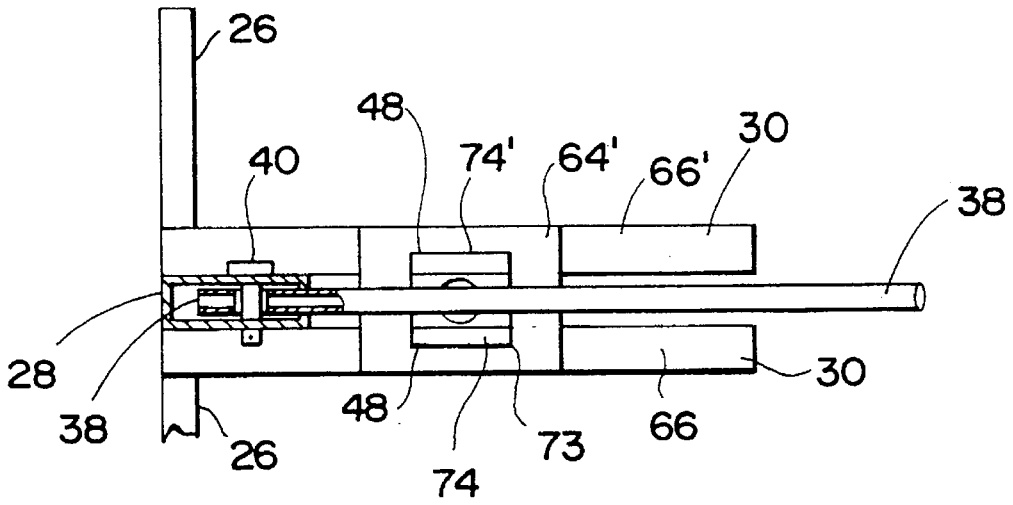
FIG. 2 is a fragmentary top plan view of the apparatus and partly in section.
Figure 3:
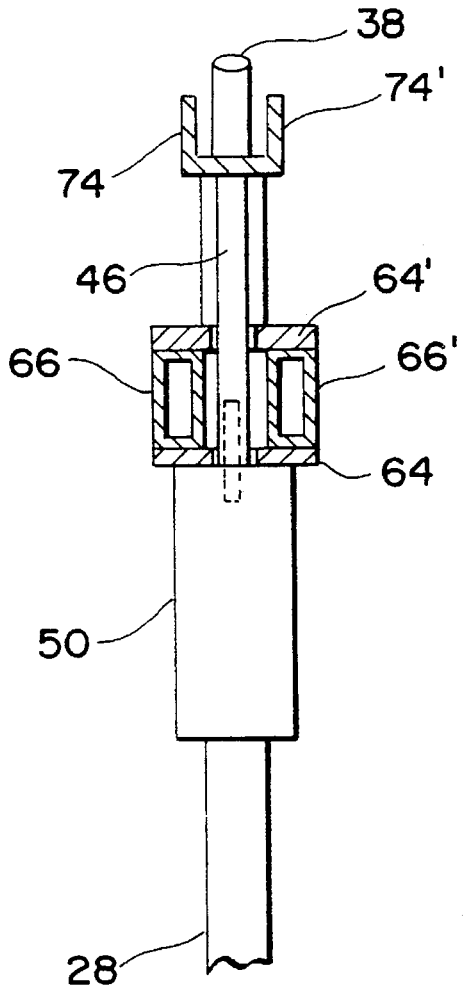
FIG. 3 is a fragmentary and partially cross-sectional front elevation view of the apparatus.
Figure 4:
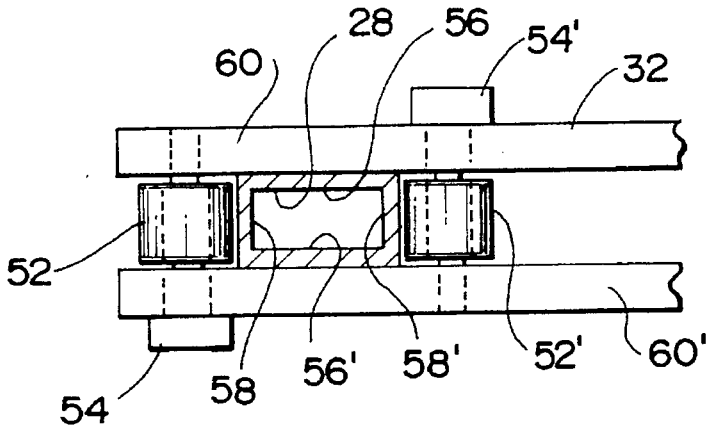
FIG. 4 is a fragmentary cross-sectional view of the apparatus taken along the line 4—4 in FIG. 1 and looking in the direction of the arrows.
Figure 5:
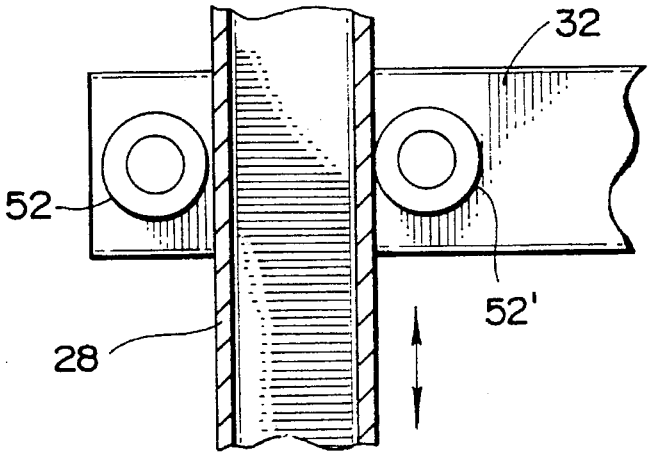
FIG. 5 is a detailed fragmentary side elevation view of a portion of the apparatus.
Figure 6:
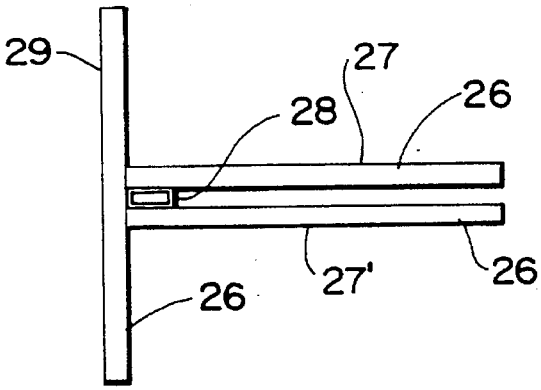
FIG. 6 is a schematic top plan view partly in cross-section of the base of the apparatus.
Figure 7:
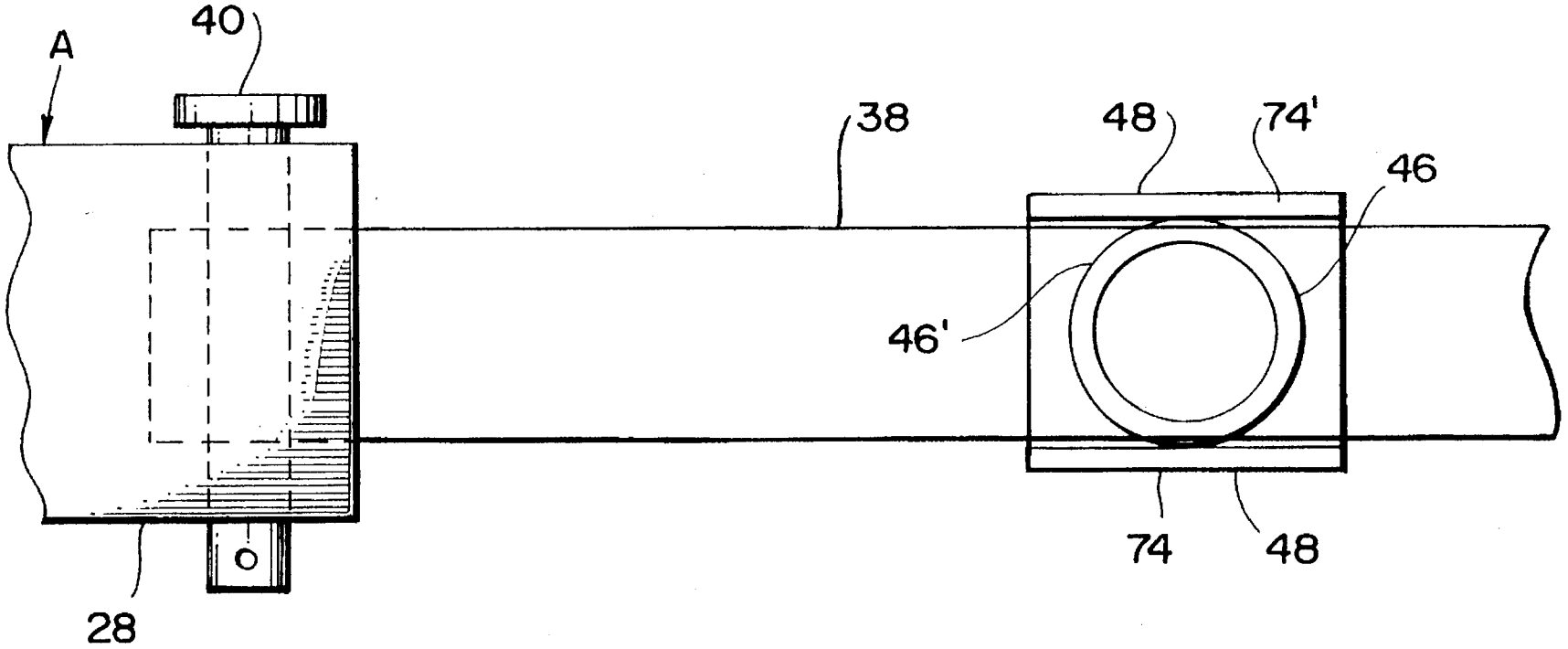
FIG. 7 is a fragmentary top plan view of a portion of the apparatus.

With reference now to the drawings, wherein like reference characters designate like or corresponding parts throughout the several views, there is shown apparatus 20 for use in combination with a conventional vehicle jack 22 for splitting logs, such as log 24. Apparatus 20 can be used with various types of conventional vehicle jacks, such as ratchet, screw and hydraulic jacks, as examples.

In accordance with the invention, apparatus 20 includes base means 26 for removably receiving and supporting jack 22 thereon and for supporting apparatus 20 on the ground or other horizontal surface. Base means 26 preferably includes first and second elongated bar members 27, 27' and an additional elongated bar member 29.

Apparatus 20 further includes a first support 28 connected in a conventional manner to and extending upwardly from base means 26. Support 28 is preferably connected to bar members 27, 27'. Apparatus 20 further includes a second support 30 conventionally connected to and extending outwardly from first support 28 and located above bar members 27, 27' of base means 26.

Apparatus 20 also includes a log support 32 movably connected to and extending outwardly from first support 28, and log support 32 is located between bar members 27, 27' of base means 26 and second support 30. Log support 32 is movably positionable on first support 28 to rest on jack 22, as shown in FIG. 1, when jack 22 is positioned on base means 26 and beneath log support 32.

Apparatus 20 further includes wedge means 34 located in operative relationship with second support 30 for engaging and splitting log 24 positioned on log support 32 and beneath wedge means 34 as log support 32 and log 24 are moved upwardly toward second support 30 by conventional activation of jack 22 positioned between base means 26 and log support 32.

Apparatus 20 further includes lever means 36 connected in movable operative relationship to first support 28 and with wedge means 34 for enabling wedge means 34 to be forcefully moved downwardly to completely split log 24 positioned on log support 32 and beneath wedge means 34.

Figure 8:
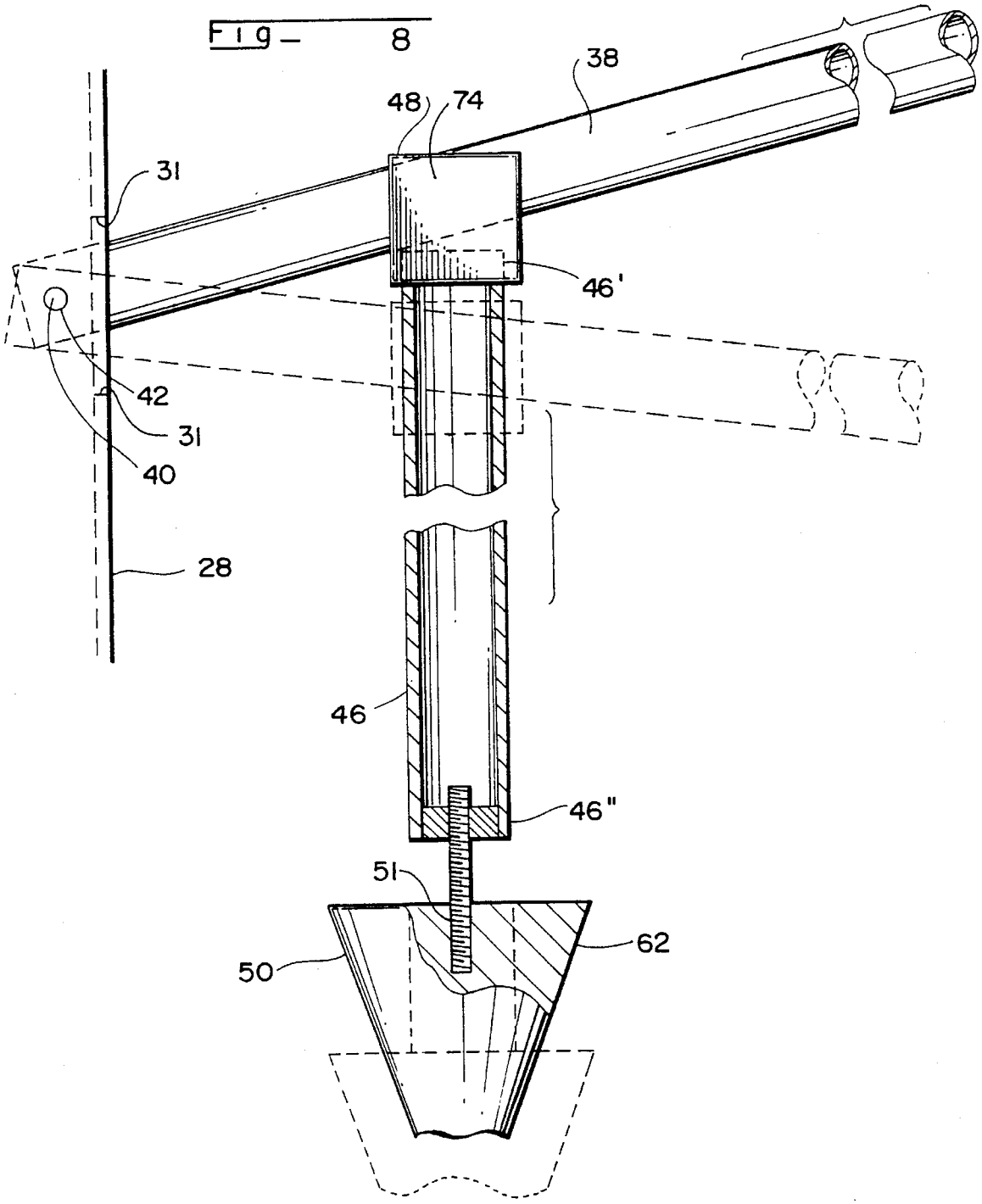
FIG. 8 is a fragmentary side elevation view, partly in section, of a portion of the apparatus and showing operation of the apparatus in phantom.
Figure 9:
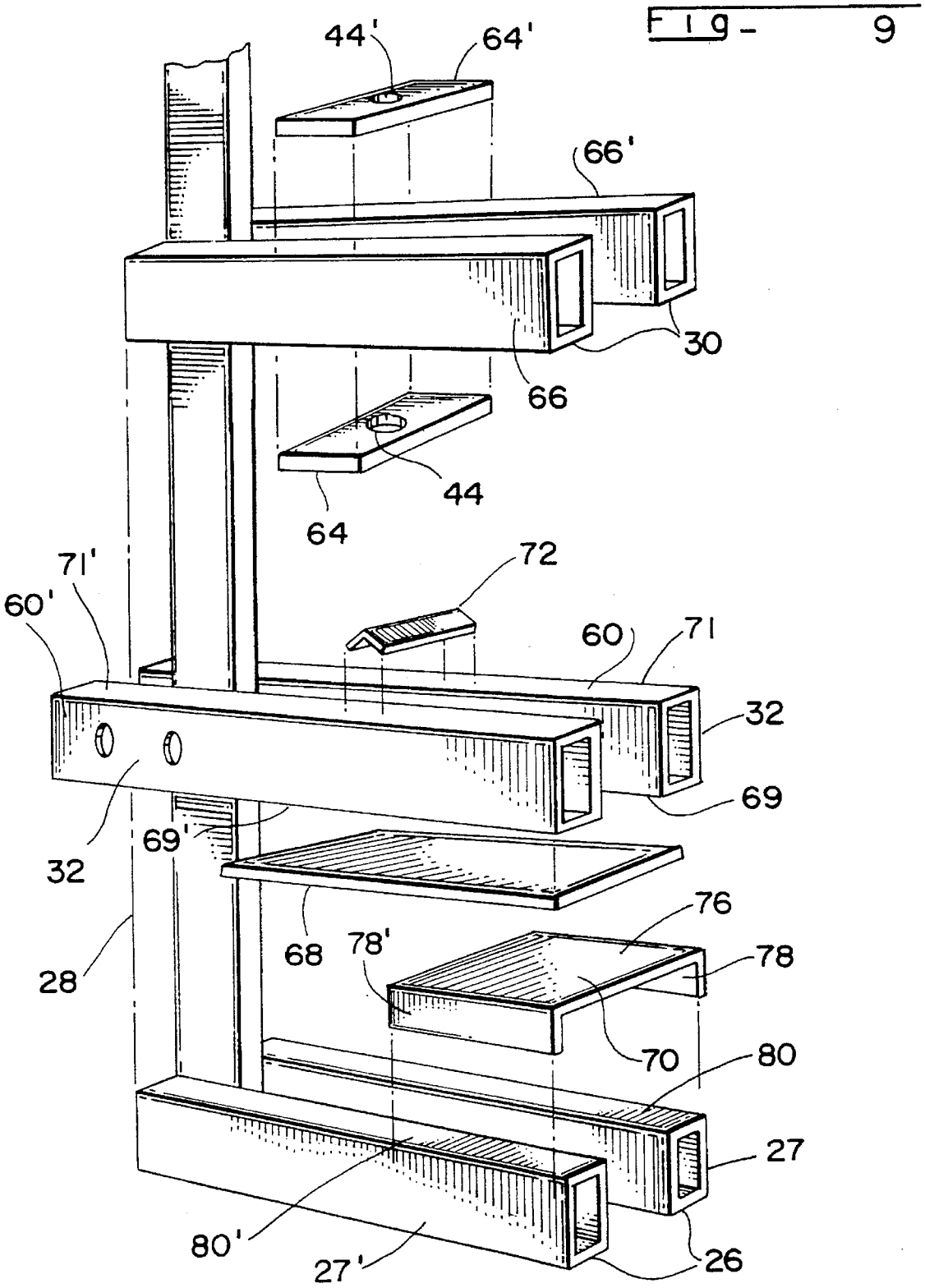
FIG. 9 is a fragmentary exploded perspective view of portions of the apparatus.

Lever means 36 include a lever arm 38 rotatably connected to first support 28 by pin member 40 at a location 42 above second support 30. An opening 31 in support 28 enables lever arm 38 to rotate about pin member 40. See FIG. 8. Second support 30 defines a first opening 44 therethrough, and wedge means 34 include a shaft 46 defining upper and lower ends 46', 46", respectively. Shaft 46 slideably extends vertically through first opening 44 in second support 30.

Wedge means 34 further include guide means 48 connected in a conventional manner to upper end 46' of shaft 46 for movably receiving lever arm 38 and for guiding relative movements of shaft 46 and lever arm 38. Guide means 48 preferably include first and second opposed, planar guide elements 74, 74' conventionally connected to upper end 46' of shaft 46.

Wedge means 34 also include a wedge 50 removably connected to lower end 46" of shaft 46 and positioned beneath second support 30 for engaging and splitting log 24. Wedge 50 is preferably removably connected to shaft 46 by means of threaded bolt 51.

In accordance with the invention, apparatus 20 includes first and second rollers 52, 52' which are connected to log support 32 by bolts 54, 54', respectively. Rollers 52, 52' engage first support 28 for enabling log support 32 to move vertically along first support 28.

First support 28 preferably includes first and second opposed sides 56, 56' and third and fourth opposed sides 58, 58' connected together to form a rectangular cross-section for first support 28. Log support 32 preferably includes first and second elongated members 60, 60' positioned, respectively, adjacent to first and second opposed sides 56, 56' of first support 28. First roller 52 is connected to and between elongated members 60, 60', and roller 52 movably engages third side 58 of first support 28. Second roller 52' is connected to and between elongated members 60, 60', and second roller 52' movably engages fourth side 58' of first support 28.

A predetermined upper portion 62 of wedge 50 is greater in size than the size of first opening 44 through second support 30 so that wedge 50 is held upwardly against second support 30 but does not pass upwardly through first opening 44 when wedge 50 engages and splits log 24 as log 24 and log support 32 are moved upwardly toward second support 30 by conventional activation of jack 22 positioned between base means 26 and log support 32.

In accordance with the invention, second support 30 preferably includes lower and upper opposed guide plates 64, 64' which are conventionally connected to and extend between members 66, 66'. Members 66, 66' are conventionally connected to first support 28. Lower guide plate 64 defines first opening 44 therein, and upper guide plate 64' defines a second opening 44' therein in alignment with first opening 44 so that shaft 46 slideably extends vertically through openings 44, 44'.

Log support 32 preferably includes a first plate member 68 which is conventionally connected to and extends between lower edges 69, 69' of elongated members 60, 60', and plate member 68 rests on jack 22. Log support 32 also preferably includes an inverted, elongated V-shaped log support member 70 which is conventionally connected to and extends between upper edges 71, 71' of elongated members 60, 60' for supporting log 24 in a manner which facilitates separation from each other of split portions of the log.

Base means 26 also preferably include a movable jack supporting member 70 upon which jack 22 is positioned and supported. Member 70 is preferably formed with a center planar portion 76 and with two opposing flange elements 78, 78' connected to and extending downwardly from center portion 76. The dimension of member 70 and the spacing between elements 78, 78' is such that member 70 can slide along top surfaces 80, 80' of bar members 27, 27' with flange elements 78, 78' acting as guides to keep member 70 positioned on bar member 27, 27'.

In operation and use, apparatus 20 is positioned on the ground or other horizontal surface and is supported by base means 26 with first support 28 extending upwardly in a substantially vertical direction. Jack supporting member 70 is adjustably positioned by sliding along top surfaces 80, 80' of bar members 27, 27' so that jack 22 can be properly positioned on and supported by supporting member 70. Log support 32 is then moved vertically along first support 28 by means of rollers 52, 52' so that log support 32 is positioned onto jack 22. See FIG. 1.

Log 24 is then placed onto log support member 72, and log 24 is manually held in position on log support member 72 while jack 22 is conventionally operated to raise log support 32 until the upper end of log 24 engages the lower sharp end of wedge 50. When the upper portion of log 24 engages the lower end of wedge 50, wedge 50 and log 24 continue to move upwardly as jack 22 is operated until upper portion 62 of wedge 50 engages lower guide plate 64. Log 24 is then firmly held in position between the lower end of wedge 50 and log support member 72. This is illustrated in FIG. 1.

Jack 22 is then further activated in a conventional manner to further raise log support 32. As log support 32 is raised by jack 22, the sharpened lower end of wedge 50 penetrates into log 24 to begin the splitting of the log. Continued activation of jack 22 causes continued upper movement of log support 32 along first support 28 until wedge 50 completely splits the log.

There may be occasions when log 24 is not completely split as a result of activation of jack 22. This may occur because the full extension of jack 22 is insufficient to completely split the log. The size of log 24 in relationship with the size of wedge 50 and the type and condition of wood contained within log 24 may also result in less than complete splitting of the log even when the upper end of the log engages lower guide plate 64 and when wedge 50 is completely inserted into the log. If log 24 is not completely split, complete splitting of the log can be achieved by downward movement of lever arm 38. The downward force exerted by lever arm 38 against upper end 46' of shaft 46 forces shaft 46 and wedge 50 downwardly and forces wedge 50 further into and through log 24 to cause complete splitting of the log. This downward movement of lever arm 38 and of wedge 50 is illustrated in phantom in FIG. 1. The inverted V-shaped configuration of log support member 72 facilitates separation of the split portions of log 24.

The split portions of the log are then manually removed from log support 32 and from log support member 72, if they haven't fallen off, and the process can be repeated with a new log.

This invention provides for an inexpensive log splitting apparatus which is easily transportable and which is safe and easy to use.

The invention in its broader aspects is not limited to the specific details shown and described, and departures may be made from such details without departing from the principles of the invention and without sacrificing its chief advantages.

What is claimed is:

1. Apparatus for use in combination with a conventional vehicle jack for splitting logs, said apparatus comprising:

base means for removably receiving and supporting said jack thereon and for supporting said apparatus on the ground or other substantially horizontal surface;

a first support connected to and extending upwardly from said base means;

a second support connected to and extending outwardly from said first support and located above said base means;

a log support movably connected to and extending outwardly from said first support and located between said base means and said second support, said log support movably positionable along said first support to rest on said jack when said jack is positioned on said base means and beneath said log support; and wedge means in operative relationship with said second support for engaging and splitting a log positioned on said log support and beneath said wedge means as said log support and said log are moved upwardly toward said second support by conventional activation of said jack positioned between said base means and said log support.

2. Apparatus as in claim 1 further including lever means connected in movable operative relationship with said first support and with said wedge means for enabling said wedge means to be moved downwardly to completely split a log positioned on said log support and beneath said wedge means.

3. Apparatus as in claim 2 wherein said lever means include a lever arm rotatably connected to said first support at a location above said second support, wherein said second support defines a first opening therethrough and wherein said wedge means include:

a shaft defining upper and lower ends and slideably extending vertically through said first opening in said second support;

guide means connected to said upper end of said shaft for movably receiving said lever arm and for guiding relative movements of said shaft and said lever arm; and a wedge connected to said lower end of said shaft and positioned beneath said second support for engaging and splitting said log.

4. Apparatus as in claim 3 wherein first and second rollers are connected to said log support and engage said first support for enabling said log support to move along said first support.

5. Apparatus as in claim 4 wherein said first support includes first and second opposed sides and third and fourth opposed sides, and wherein said log support includes:

first and second elongated members positioned, respectively, adjacent to said first and second opposed sides of said first support;

said first roller connected to and between said first and second elongated members and movably engaging said third side of said first support; and said second roller connected to and between said first and second elongated members and movably engaging said fourth side of said first support.

6. Apparatus as in claim 3 wherein said wedge is removably connected to said lower end of said shaft to permit replacement of said wedge.

7. Apparatus as in claim 3 wherein a predetermined upper portion of said wedge is greater in size than the size of said first opening through said second support, whereby said wedge is held upwardly against said second support but does not pass upwardly through said first opening when said wedge engages and splits said log as said log and said log support are moved upwardly toward said second support by conventional activation of said jack positioned between said base means and said log support.

8. Apparatus as in claim 7 wherein said second support includes lower and upper opposed guide plates, said lower guide plate defining said first opening therein and said upper guide plate defining a second opening therein in alignment with said first opening, whereby said shaft slideably extends vertically through said first and second openings.

9. Apparatus as in claim 8 wherein said log support includes a first plate member for resting on said jack.

10. Apparatus as in claim 9 wherein said base means include a movable jack supporting member.

11. Apparatus as in claim 10 wherein said log support includes an inverted V-shaped log support member for supporting said log in a manner which facilitates separation of split portions of said log.

12. Apparatus as in claim 3 wherein said guide means include first and second opposed, substantially planar guide elements connected to said shaft.

* * * * *